US011849764B2

(12) United States Patent
Pohl et al.

(10) Patent No.: US 11,849,764 B2
(45) Date of Patent: Dec. 26, 2023

(54) TANK APPARATUS FOR AN ELECTRONIC INHALATION DEVICE, ELECTRONIC INHALATION DEVICE AND METHOD FOR AUTHENTICATING A TANK APPARATUS OF AN ELECTRONIC INHALATION DEVICE

(71) Applicant: Infineon Technologies AG, Neubiberg (DE)

(72) Inventors: Jens Pohl, Bernhardswald (DE); Thomas Lehmann, Sinzing (DE); Frank Pueschner, Kelheim (DE)

(73) Assignee: Infineon Technologies AG, Neubiberg (DE)

( * ) Notice: Subject to any disclaimer, the term of this patent is extended or adjusted under 35 U.S.C. 154(b) by 589 days.

(21) Appl. No.: 16/896,585

(22) Filed: Jun. 9, 2020

(65) Prior Publication Data

US 2020/0404966 A1 Dec. 31, 2020

(30) Foreign Application Priority Data

Jun. 26, 2019 (DE) ..... 102019117231.4

(51) Int. Cl.
*A24F 40/42* (2020.01)
*A24F 40/53* (2020.01)

(52) U.S. Cl.
CPC ..... *A24F 40/42* (2020.01); *A24F 40/53* (2020.01)

(58) Field of Classification Search
CPC ..... A24F 40/53; A24F 40/10; A24F 40/42
See application file for complete search history.

(56) References Cited

U.S. PATENT DOCUMENTS

2014/0190478 A1* 7/2014 Liu ..... A24F 40/44 128/202.21
2019/0099561 A1 4/2019 Nettenstrom

FOREIGN PATENT DOCUMENTS

AU 2013391954 * 1/2016
CN 107205469 A * 9/2017 ..... A24F 40/53
WO 2014166079 * 10/2016

OTHER PUBLICATIONS

German Patent Office, Office Action issued for DE 102019117231.4, 5 pgs., dated Apr. 27, 2020.

* cited by examiner

*Primary Examiner* — Jean F Duverne
(74) *Attorney, Agent, or Firm* — Banner & Witcoff Ltd.

(57) ABSTRACT

A tank apparatus for an electronic inhaler, including a receptacle configured to hold a liquid to be vaporized, two supply lines configured to apply an electrical supply voltage to an electrical heater, and an authentication circuit configured to authenticate the tank apparatus. The authentication circuit has two supply terminals configured to apply an electrical supply voltage, and at least one of the supply lines is connectable to at least one of the supply terminals in an electrically conductive manner.

11 Claims, 7 Drawing Sheets

TANK APPARATUS FOR AN ELECTRONIC INHALATION DEVICE, ELECTRONIC INHALATION DEVICE AND METHOD FOR AUTHENTICATING A TANK APPARATUS OF AN ELECTRONIC INHALATION DEVICE

TECHNICAL FIELD

The present disclosure relates to a tank apparatus for an electronic inhalation device, to an electronic inhalation device, and to a method for authenticating a tank apparatus of an electronic inhalation device.

BACKGROUND

An electronic inhalation device 100 according to the prior art, which is shown by way of example in FIG. 1, typically consists of a base device 104, which comprises, for example, an electronic controller for producing vapor, and, as a voltage supply, a battery or a rechargeable battery, which can be charged by a charging device, and of a tank apparatus 102, also called a pod, in which are located a tank (also called a reservoir), containing a liquid to be vaporized, and a heating coil and a wick, said heating coil being used to heat the liquid located at the wick so as to form the vapor that can be inhaled by the user.

FIG. 1 shows the basic principle of operation of the electronic inhalation device 100 during vapor production. A connection of the tank apparatus 102 to the base device 104 is made. The base device 104 has two voltage-supply contacts 226 (a corresponding voltage is provided by a voltage storage device 222, e.g. a battery or a rechargeable battery), which are brought into contact with corresponding contacts 228 of the tank apparatus 102. The contacts 228 of the tank apparatus 102 are connected to the heating coil 230. The tank of the tank apparatus 102 is filled with the liquid 220 from which the vapor to be consumed is produced. A wick 232 is used to feed the liquid 220 to the heating coil 230 for vaporizing.

When a user starts to inhale, this is detected by electronic means, for instance a control device 224 of the base device 104, for example by means of a pressure sensor, and the control device 224 starts to heat the heating coil 230, with the result that vapor is produced in a heating-coil/wick contact region.

The tank apparatus 102, wherein the liquid 220 to be vaporized is located in a receptacle 236, is usually a disposable item, i.e. a consumable item that cannot be refilled. The tank apparatus 102 can be provided with an authentication device to prevent fraudulent use, for instance prohibited refilling of the tank apparatus 102 or using unauthorized tank apparatuses 102 from third-party manufacturers. This is shown by way of example in FIGS. 2A and 2B.

When the tank apparatus 102 is connected to the base device 104, the authentication device, for instance an authentication circuit 330, is connected to the base device 104 by means of additional connecting terminals 332, 338. A control device 224, which may be part of the base device 104, can be designed to ascertain in conjunction with the authentication device 330 that the tank apparatus 102 is a permitted apparatus.

The electronic inhalation device works only if the tank apparatus 102 is a permitted apparatus, i.e. is authenticated by the authentication device. The electronic inhalation device is designed to refuse to operate otherwise. Similar anti-fraud strategies are used, for example, with other consumables such as printer cartridges.

A disadvantage of an independent authentication device may be that the base device 104 and the tank apparatus 102 have a more complex design, which can result from the need for additional contacts. The plug-in electrical contacts between base device and tank apparatus must be provided in the form of spring contacts, which can lead to relatively high material and/or manufacturing costs.

The authentication circuit 330 shown in FIGS. 2A and 2B has three contacts surfaces, namely two contact surfaces 336 for a VCC and a VSS voltage supply 338, and an additional contact surface 334 for a single line 332 for data transfer, also denoted by SWI for "single wire interface". This means that at least three contacts are needed in the base device 104, namely two contacts for the voltage supply and an additional contact for the data transfer. If it is also intended to allow the tank apparatus 102 to be arranged in two possible orientations, then 2×3 contacts may be needed in order to allow both a first arrangement and a mirrored arrangement. This means that a mechanical complexity of such a device can be relatively high.

SUMMARY

In various exemplary embodiments, an inexpensive authentication facility is provided by embedding an authentication circuit in existing fundamental functions of a tank apparatus of an electronic inhalation device.

For example, the electronic inhalation device may be an electronic cigarette, also known as an e-cigarette.

In various exemplary embodiments, a reduction in costs is achieved by further miniaturization of the authentication circuit and by reducing a mechanical complexity of the system.

Various exemplary embodiments afford the user large cost savings by reducing a complexity and production costs of a tank apparatus.

In order to achieve the advantages mentioned, part or all of an authentication circuit may already be integrated in existing connections between a base device and a tank apparatus. The authentication circuit may also be part of the tank apparatus.

In various exemplary embodiments, for a tank apparatus, supply lines for the voltage supply for an electrical heating apparatus can be used additionally for the voltage supply to an authentication circuit. In various exemplary embodiments, the supply lines can additionally be used for exchanging a wanted signal between the base device and the tank apparatus. User data, for instance, can be transferred by means of the wanted signal. The user data may relate to the authentication, for example.

In various exemplary embodiments, a wanted-signal terminal for transferring the wanted signal, so for instance for exchanging user data, may be provided. In this case, the wanted-signal terminal can be arranged between two supply lines. This can relate in particular to exposed contacts of the wanted-signal terminal and of the supply lines. The tank apparatus can hence be guaranteed to operate regardless of a polarity of the voltage supply (i.e. the tank apparatus can be designed for it not to matter which of the supply lines, e.g. VSS or VCC, is connected), with the result that connecting the tank apparatus to the base device can work in two orientations rotated through 180°.

In various exemplary embodiments, for instance those presented above or in the detailed description, a tank apparatus can be provided that is less expensive that in the prior art. The reasons for this are that a housing of the authentication circuit (package) can be miniaturized (e.g. with what are known as chip-sized packages, CSP) and/or that the mechanical complexity can be reduced by simplifying an electrical connection between a base device and a tank apparatus.

BRIEF DESCRIPTION OF THE DRAWINGS

Exemplary embodiments of the present disclosure are described in more detail below and are shown in the figures, in which.

DETAILED DESCRIPTION

In the following detailed description, reference is made to the accompanying drawings, which form part of this description and which show for the purpose of illustration, specific embodiments in which the present disclosure can be applied. In this regard, direction terminology such as "above", "below", "in front", "behind", "front", "rear", etc. is used with reference to the orientation in the figure(s) described. Since components of embodiments can be positioned in a number of different orientations, the direction terminology is used for the purpose of illustration and has no limiting effect whatsoever. Obviously, other embodiments can be used and structural or logical modifications can be made without departing from the scope of protection of the present disclosure. Of course the features of the various exemplary embodiments described here can be combined with one another unless specifically stated otherwise. Therefore the following detailed description shall not be interpreted in any limiting sense, and the scope of protection of the present disclosure is defined by the accompanying claims.

In this description, the terms "connected", "attached" and "coupled" are used to describe both a direct and an indirect connection, a direct or indirect attachment, and a direct or indirect coupling. In the figures, identical or similar elements are denoted by the same reference signs where this is expedient.

Different aspects of the disclosure are provided for devices, and different aspects of the disclosure are provided for methods. Obviously the fundamental characteristics of the devices apply also to the methods, and vice versa. Therefore it may be the case that such characteristics have not been described twice for the sake of brevity.

Figure 1:
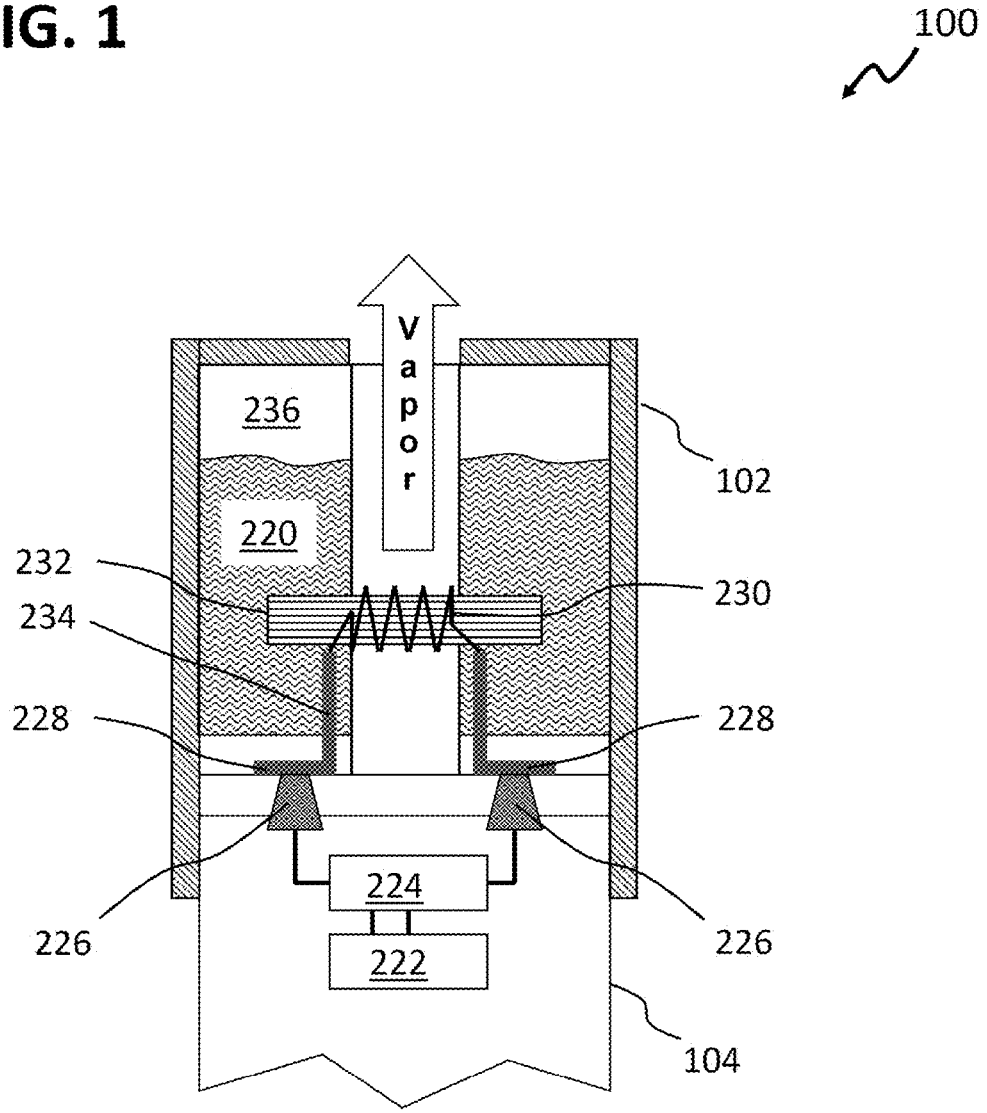
FIG. 1 shows a schematic cross-sectional view of parts of an electronic inhalation device according to the prior art.
Figure 2A:
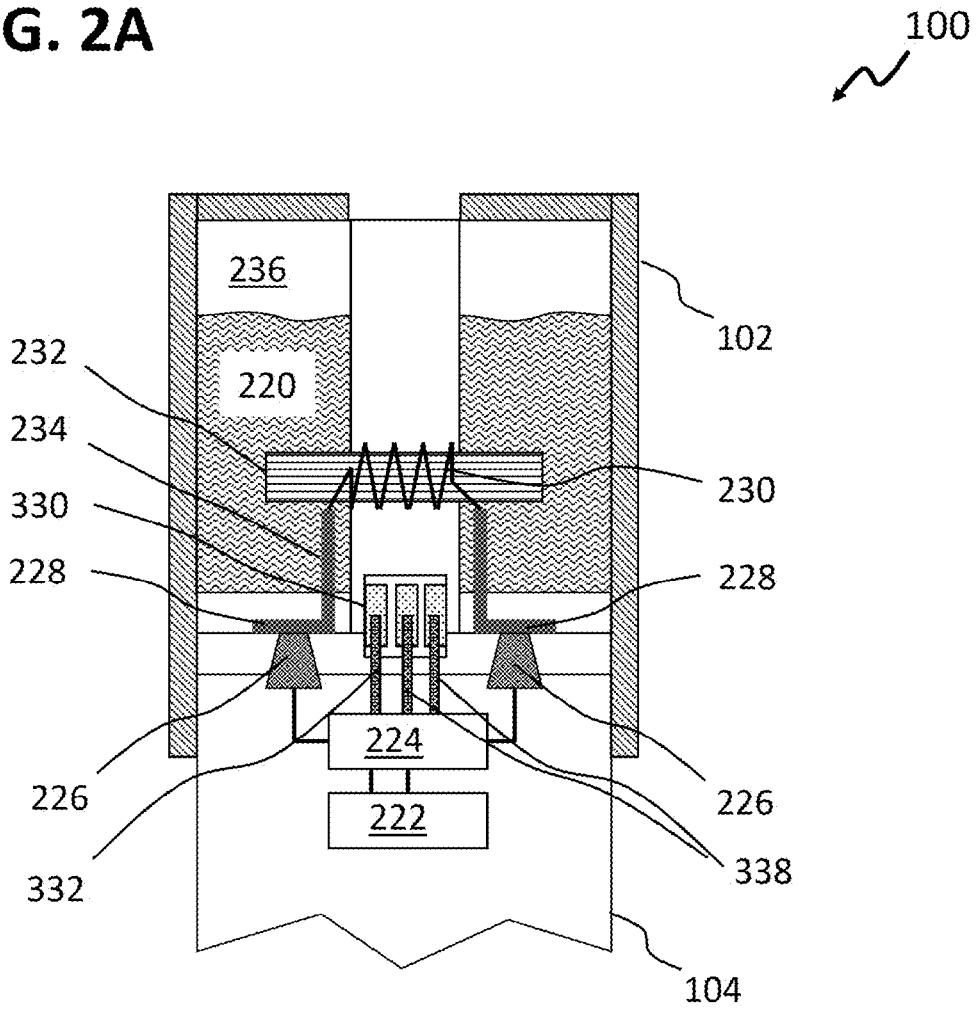
FIG. 2A shows a schematic cross-sectional view of parts of an electronic inhalation device having an authentication circuit according to the prior art.
Figure 2B:
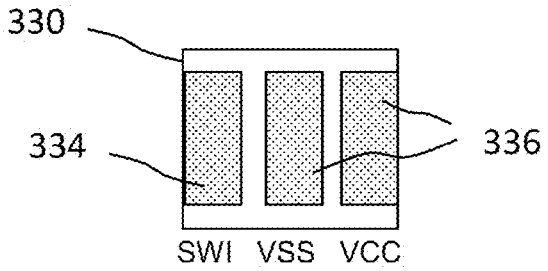
FIG. 2B shows an enlarged view of the authentication circuit from FIG. 2A.
Figure 3A:
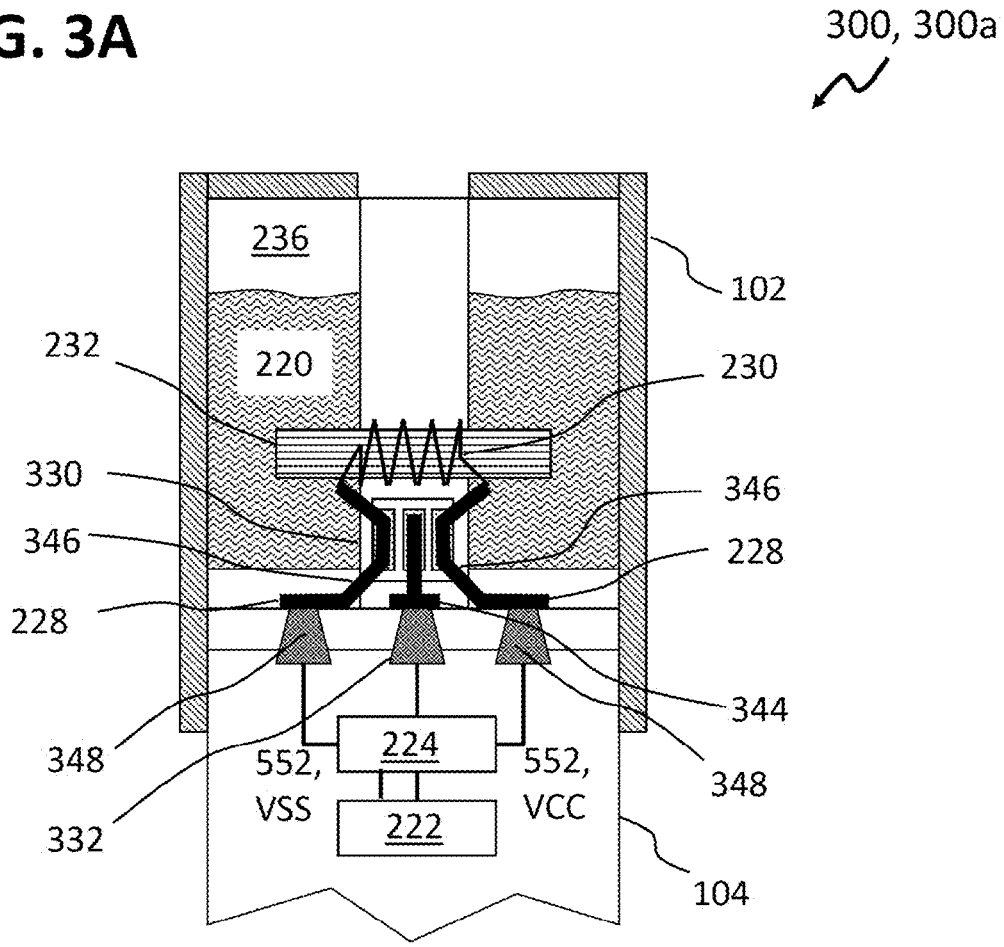
FIG. 3A shows a schematic cross-sectional view of parts of an electronic inhalation device having an authentication circuit according to various exemplary embodiments.
Figure 3B:
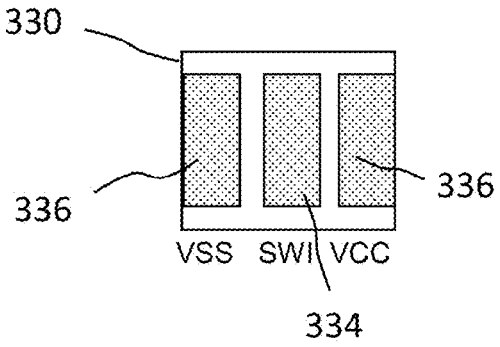
FIG. 3B shows an enlarged view of the authentication circuit from FIG. 3A.
Figure 4A:
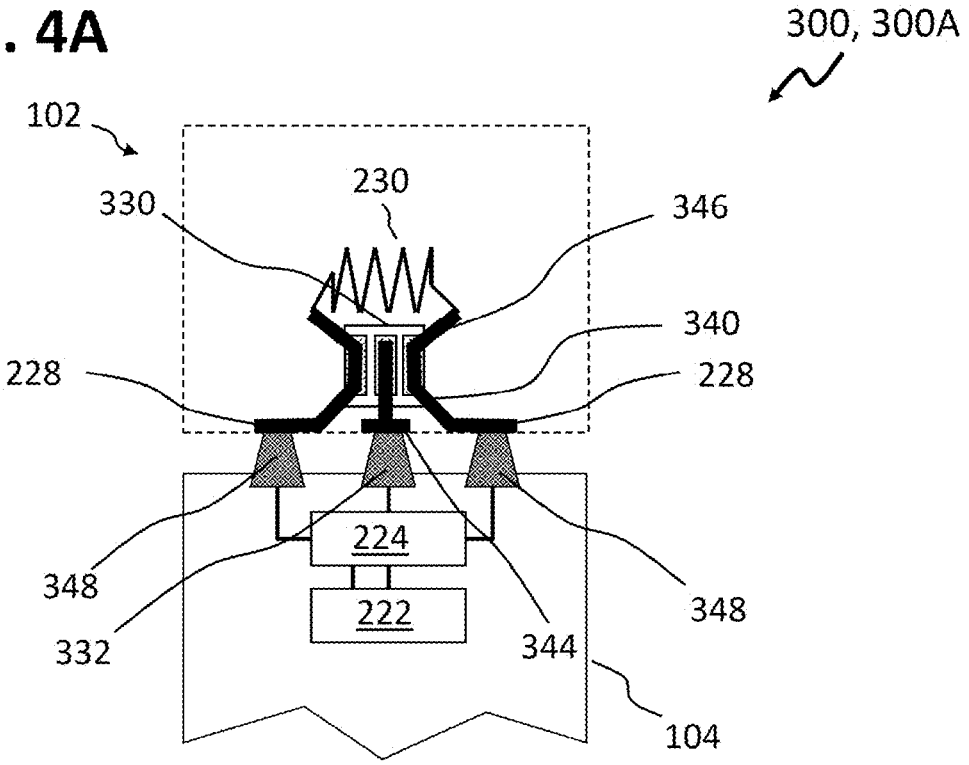
FIG. 4A shows a schematic cross-sectional view of parts of an electronic inhalation device having an authentication circuit according to various exemplary embodiments.
Figure 4B:
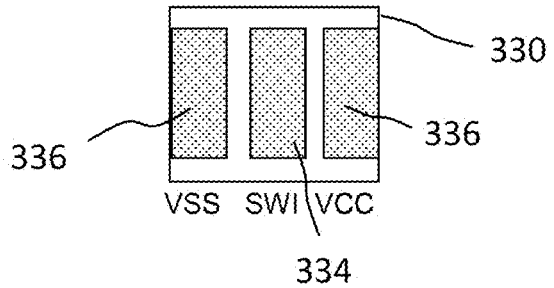
FIG. 4B shows an enlarged view of the authentication circuit from FIG. 4A.
Figure 4C:
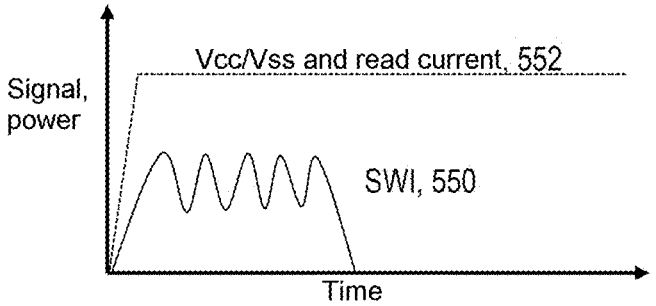
FIG. 4C shows a schematic diagram of power provided by a base device from FIG. 4A and of signals exchanged between the base device and the tank apparatus.
Figure 5A:
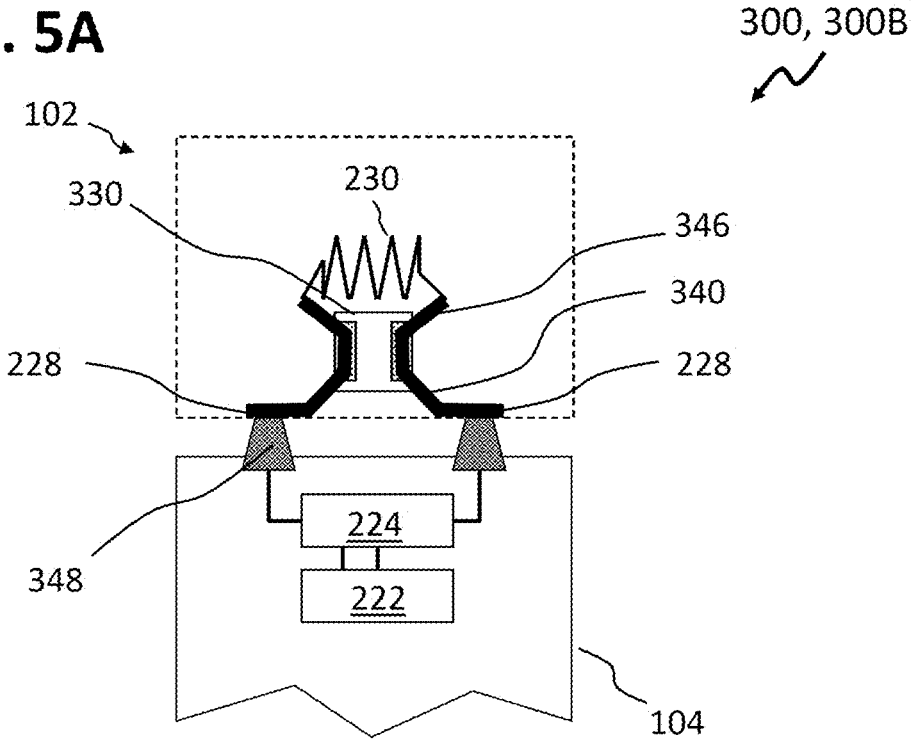
FIG. 5A shows a schematic cross-sectional view of parts of an electronic inhalation device having an authentication circuit according to various exemplary embodiments.
Figure 5B:
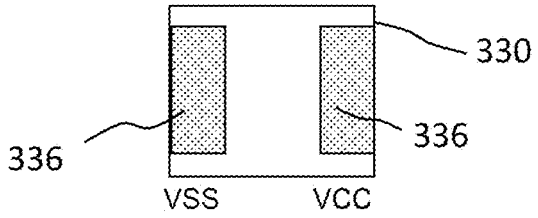
FIG. 5B shows an enlarged view of the authentication circuit from FIG. 5A.
Figure 5C:
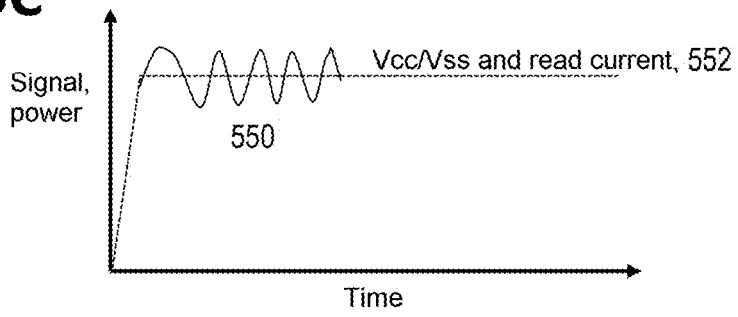
FIG. 5C shows a schematic diagram of power provided by a base device from FIG. 5A and of signals exchanged between the base device and the tank apparatus.

FIG. 3A, FIG. 4A, FIG. 5A and FIG. 6A each show a schematic cross-sectional view of parts of an electronic inhalation device 300 having an authentication circuit 330 according to various exemplary embodiments. FIG. 3B, FIG. 4B, FIG. 5B and FIG. 6B each show an enlarged view of the authentication circuit 330 from the associated FIG. 3A, FIG. 4A, FIG. 5A and FIG. 6A respectively. And FIG. 4C, FIG. 5C and FIG. 6C each show a schematic diagram of power provided by a base device from the associated FIG. 4A, FIG. 5A and FIG. 6A respectively, and of signals exchanged between the base device and the tank apparatus. FIGS. 3A and 3B and FIGS. 4A, 4B and 4C relate to the same exemplary embodiment 300A; FIGS. 5A, 5B and 5C relate to an exemplary embodiment 300B, and FIGS. 6A, 6B and 6C relate to an exemplary embodiment 300C.

The electronic inhalation device 300 can comprise a base device 104 and a tank apparatus 102.

Figure 6A:
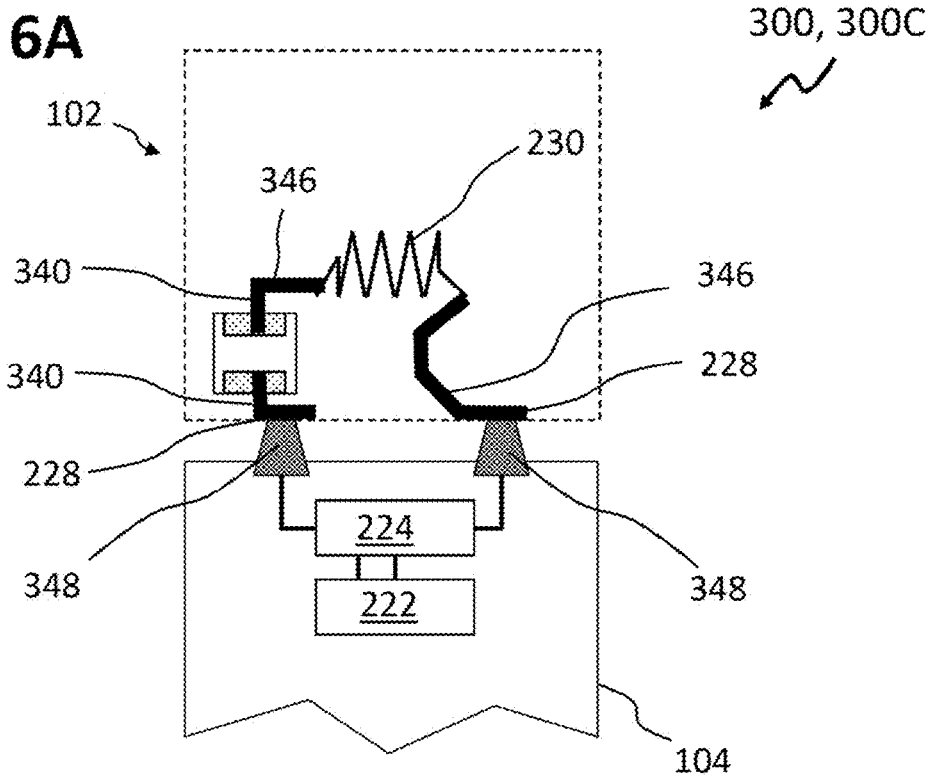
FIG. 6A shows a schematic cross-sectional view of parts of an electronic inhalation device having an authentication circuit according to various exemplary embodiments.
Figure 6B:
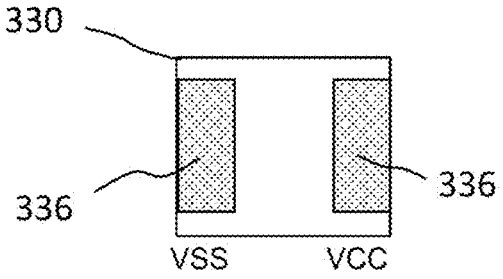
FIG. 6B shows an enlarged view of the authentication circuit from FIG. 6A.

According to various exemplary embodiments, for instance as shown in FIG. 3A for the electronic inhalation device 300, 300A, the tank apparatus 102 can comprise a receptacle 236 for holding a liquid 220 to be vaporized, and an electrical heating apparatus 230, for example a heating coil, for vaporizing the liquid 220 (in FIG. 4A, FIG. 5A and FIG. 6A, the receptacle and further details of the electronic inhalation device are omitted for the sake of clarity, and essentially only the electrical components are shown).

The tank apparatus 102 can additionally comprise two supply lines 346 for applying an electrical supply voltage 552, e.g. VSS and VCC, to the electrical heating apparatus 230.

The supply lines 346 can in part be exposed contacts 228, which serve to make mechanical and electrically conductive contact with compatibly formed base contacts 226 of the base device 104 on connection of the tank apparatus 102 to the base device 104. As shown in FIG. 3A, FIG. 4A and FIG. 5A, the supply lines 346 can thereby form connecting terminals that are external to the tank apparatus. By this is meant that although they are part of the tank apparatus 102, they serve to connect a voltage supply 222, for instance specifically a battery or a rechargeable battery, which is external to the tank apparatus and is designed to provide the supply voltage 552 to the heating apparatus 230.

The tank apparatus 102 may also comprise an authentication circuit 330, which can be designed to authenticate the tank apparatus 102. In this context, authentication means that manufacturers of electronic inhalation devices usually want to prevent, for example, tank apparatuses 102 from third-party suppliers being attached to, and operated with, their base devices 104. Authentication involves determining whether the attached tank apparatus 102 is a "permitted"

tank apparatus 102, i.e. a tank apparatus 102 that has been made by the manufacturer of the base device 104 or given clearance for use with the manufacturer's base device 104.

The authentication circuit 330 can comprise two supply terminals 336 for applying the electrical supply voltage 552 (e.g. VSS, VCC, which are also used for heating the heating device 230; in the context of the authentication circuit 330 this is also referred to as a read current 552) to the authentication circuit 330. At least one of the supply lines 346 may be connected to at least one of the supply terminals 336 in an electrically conductive manner.

In the exemplary embodiments from FIG. 3A, FIG. 4A and FIG. 5A, both supply terminals 336 are connected as a pair to the two supply lines 346 in an electrically conductive manner. This is shown schematically in each of the figures as a line that runs from the exposed contacts 228 via the supply terminals 336 of the authentication circuit 330 to the heating apparatus 230.

The formation of the supply terminals 336 (which is not presented in detail in the figures) as a conductive connection between the authentication circuit 330 and the exposed contacts 228 of the tank apparatus 102 can be produced in various exemplary embodiments by soldering, or adhesively bonding by means of a conductive adhesive, the authentication circuit 330 onto the exposed contacts 228. Other possible ways are to fasten the authentication circuit 330 by means of a clip or crimp contact and to form a pressure contact between the authentication circuit 330 and the exposed contacts 228 by embedding in an encapsulation material, for instance a potting material.

In the exemplary embodiment from FIG. 6A, only one of the supply lines 346, namely the supply line that leads to the exposed contact surface 228, forms a connecting terminal external to the tank apparatus. The other supply line 346 is connected to the authentication circuit 330, specifically to one of the supply terminals 336, (and by means thereof indirectly to the second exposed contact 228). In addition, the second of the supply terminals 336 is connected directly to the second exposed contact 228 in an electrically conductive manner. This means that one of the supply terminals 336 forms a connecting terminal external to the tank apparatus, whereas the other supply terminal 336 is connected to the heating apparatus 230 (and by means thereof indirectly to the first exposed contact 228).

For the tank apparatus 102, the supply lines 346 designed for the voltage supply for the electrical heating apparatus 230 can be used additionally for the voltage supply for the authentication circuit 330.

The supply lines 346 can additionally be used for transferring a wanted signal 550, for instance for exchanging user data, between the base device 104 and the tank apparatus 102. The user data may relate to the authentication, for example. A corresponding exemplary embodiment is shown in FIGS. 5A, 5B and 5C and in FIGS. 6A, 6B and 6C. It is evident from the detailed view of the authentication circuit 330 in FIGS. 5B and/or 6B that this circuit has only the two supply terminals 336, which are labeled VSS and VCC respectively in order to show that the supply terminals 336 are connected to the supply lines 346 in an electrically conductive manner, with the result that the voltage which is provided to the electrical heating apparatus 230 connected in parallel with the authentication circuit 330 can likewise be provided to the authentication circuit 330 as the supply voltage (here VSS, VCC).

Figure 6C:
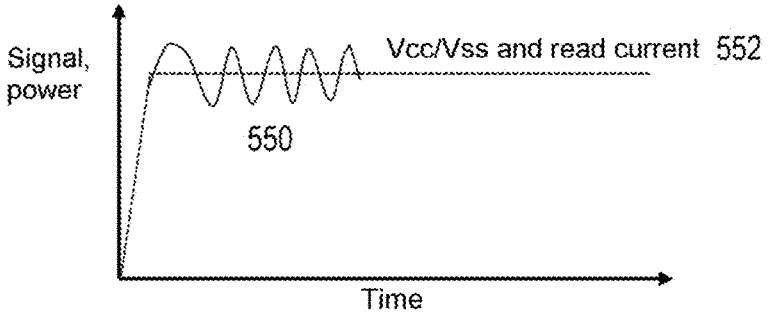
FIG. 6C shows a schematic diagram of power provided by a base device from FIG. 6A and of signals exchanged between the base device and the tank apparatus.

As shown in FIG. 5C and FIG. 6C, when the supply lines 346 are being used simultaneously for transferring the supply voltage 552 and the wanted signal 550, the wanted signal 550 can be modulated onto the supply voltage 552.

The authentication circuit 330 can comprise a demodulator (not shown) for demodulating the wanted signal 550 modulated onto the supply voltage 552 (comparable to Powerline technology). The control device 224, for example, can provide the wanted signal 550. The control device 224 can comprise a modulator for modulating the wanted signal 550 onto the supply voltage 552.

The authentication circuit 330 can comprise a modulator (not shown) for modulating the wanted signal 550 onto the supply voltage 552. The wanted signal 550 can be provided to the control device 224, for example. The control device 224 can comprise a demodulator for demodulating the wanted signal 550.

As described in connection with FIG. 3A to FIG. 6C, the tank apparatus 102 can be provided with different layouts of an interconnection of the authentication circuit 330, for instance in parallel with the heating apparatus 230 or in series with the heating apparatus, including or excluding an additional wanted-signal terminal 334. Which of the layouts is most suitable for an electronic inhalation device 300 can depend on various boundary conditions, for instance on an interconnection of the base device 104, on an electrical resistance of the heating apparatus (e.g. of the heating coil) 230 and/or on a voltage requirement or current consumption of the authentication circuit 330.

The authentication circuit 330 can comprise, depending on its interconnection, further functional parts, for instance passive components (e.g. L, C, R) or specific diodes or specific power semiconductors.

The base device 104 can provide the tank apparatus 102 with the supply voltage 552, for instance by means of the two base contacts 226, which are brought into contact with the exposed contacts 228 of the tank apparatus 102, for example as described above.

The supply voltage 552 can be applied to the authentication circuit 330 immediately after the base contacts 348 (and, if applicable, 332; see explanation below) are brought into contact with the exposed contacts 228. The authentication can thereby start immediately. In various exemplary embodiments, providing the supply voltage 552 to the heating apparatus 230 can remain inhibited at the time, i.e. the authentication circuit 330 can be in operation before the heating apparatus 230. The supply voltage 552 can be provided to the authentication circuit 330 and to the heating apparatus 230 simultaneously, i.e. the authentication circuit 330 and the heating apparatus are simultaneously in operation.

The tank apparatus 102 and/or the authentication circuit 330 can be designed to perform the authentication entirely in the authentication circuit 330 and to convey to the base device 104 only a result (i.e. authentication has passed or failed). A control device 224, which may be part of the base device 104, can be designed to operate the tank apparatus 102 according to the result, e.g. to produce the vapor on demand if the authentication has passed, and to prevent operation if the authentication has failed.

The tank apparatus 102 and/or the authentication circuit 330 can be designed to provide merely an authentication signal, for instance a code or the like. The authentication signal can be conveyed to the control device 224, for example. The control device 224 can be designed to perform the authentication. Again in these exemplary embodiments, the control device 224 can be designed to operate the tank apparatus 102 according to the result, e.g. to produce the vapor on demand if the authentication has passed, and to prevent operation if the authentication has failed.

In various exemplary embodiments, for instance as shown in FIGS. 3A and 3B and in FIGS. 4A, 4B and 4C, a wanted-signal terminal 334, which may be connected to an exposed contact 344 in an electrically conductive manner, can be provided, in addition to the supply lines 346, for transferring the wanted signal 550 between the base device 104 and the tank apparatus 102.

This means that the supply voltage 552 for the authentication circuit 330 can be provided jointly with the supply voltage 552 for the heating apparatus 230, for instance, as already described above, by it being possible for at least one of the supply lines 346 to be connected to at least one of the supply terminals 336 in an electrically conductive manner. As shown in FIG. 4C, the wanted signal 550, however, can be provided as an independent signal at the wanted-signal terminal 334. In order to make contact with the wanted-signal terminal 334, for instance at the exposed contact 344, a wanted-signal base contact 332 can be provided in the base device.

The exposed contact 344 of the wanted-signal terminal 334 can be arranged in such a way in the tank apparatus 102, for instance on a central longitudinal axis of the tank apparatus 102 or of the electronic inhalation device 300 between the exposed contacts 228, that in the event of the tank apparatus 102 being rotated through 180° about the central longitudinal axis, the exposed contacts 228 of the supply lines 346 merely swap places. This can hence allow the tank apparatus 102 to be brought into contact with the base device 104, and to be operated, in two orientations rotated through 180°, provided the tank apparatus 102 tolerates reversal of the polarity of the supply voltage 552, e.g. VCC and VSS.

In various exemplary embodiments (so e.g. also when the wanted-signal terminal 334 is not present), the exposed contacts 228 of the supply lines 346 can be arranged such that in the event of the tank apparatus 102 being rotated through 180° about the central longitudinal axis, they merely swap places.

The authentication circuit 330 can be embedded entirely in the tank apparatus 102, for instance by encapsulating (e.g. by potting) the authentication circuit 330 once it has been connected to the exposed contacts 228 of the tank apparatus 102 in an electrically conductive manner.

The authentication circuit 330 can be mounted on the exposed contacts 228 of the tank apparatus 102 by being arranged in an opening in the tank apparatus 102, for instance in an opening in an encapsulation of the tank apparatus 102. Then the opening can be sealed, for instance using epoxy, or left open.

Figure 7:
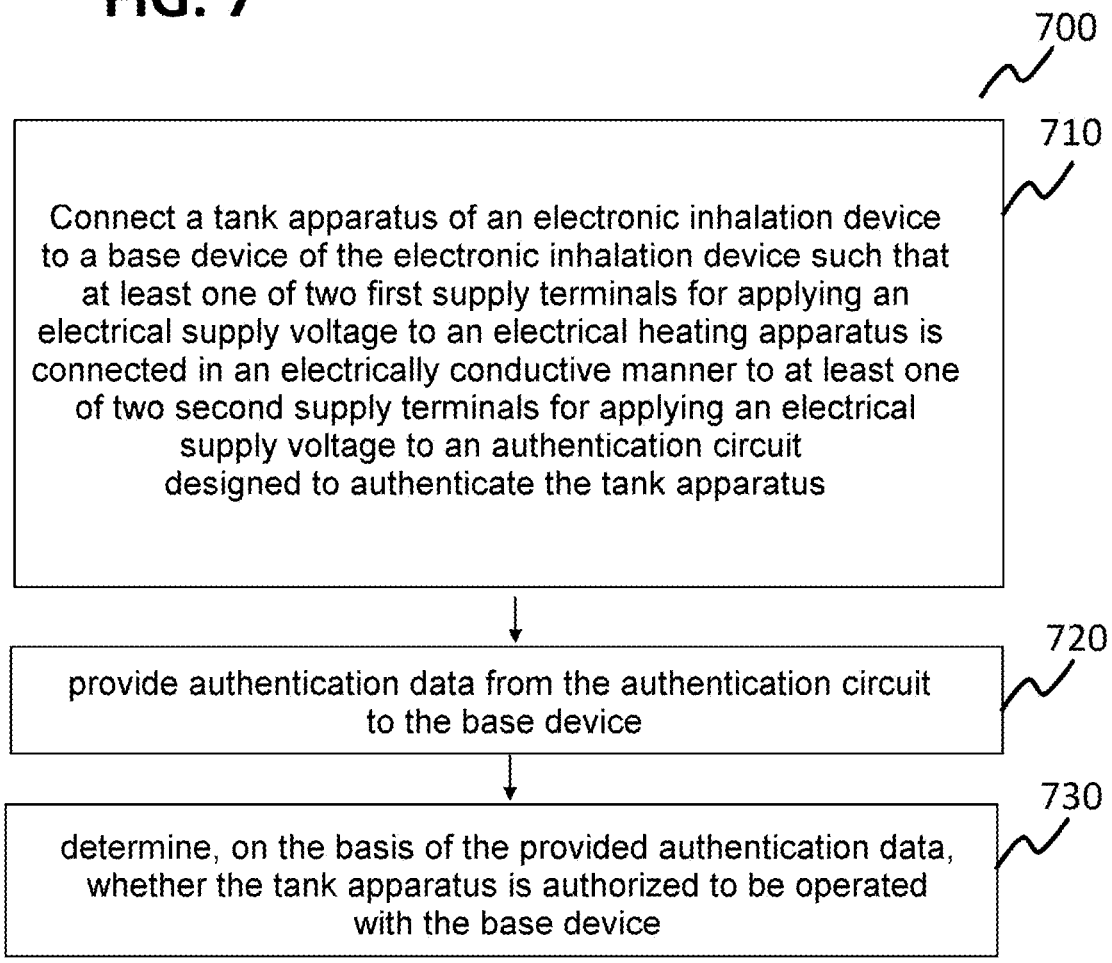
FIG. 7 shows a flow diagram of a method for authenticating a tank apparatus of an electronic inhalation device according to various exemplary embodiments.

FIG. 7 shows a flow diagram 700 of a method for authenticating a tank apparatus of an electronic inhalation device according to various exemplary embodiments.

The method can comprise connecting a tank apparatus of an electronic inhalation device to a base device of the electronic inhalation device such that at least one of two supply lines for applying an electrical supply voltage to an electrical heating apparatus is connected in an electrically conductive manner to at least one of two supply terminals for applying an electrical supply voltage to an authentication circuit designed to authenticate the tank apparatus (in 710). The method can also comprise providing authentication data from the authentication circuit to the base device (in 720), and determining, on the basis of the provided authentication data, whether the tank apparatus is authorized to be operated with the base device (in 730).

The method can be performed using a tank apparatus and/or an electronic inhalation device according to any of the exemplary embodiments described above.

Some examples are given below in summary.

Example 1 is a tank apparatus for an electronic inhalation device. The tank apparatus can comprise a receptacle for holding a liquid to be vaporized, two supply lines for applying an electrical supply voltage to an electrical heating apparatus, and an authentication circuit designed to authenticate the tank apparatus. Said authentication circuit can comprise two supply terminals for applying an electrical supply voltage, and at least one of the supply lines can be connected to at least one of the supply terminals in an electrically conductive manner.

Example 2 is a tank apparatus according to example 1, which additionally comprises an electrical heating apparatus for vaporizing the liquid held in the receptacle, wherein the two supply lines are connected to the electrical heating apparatus in an electrically conductive manner.

Example 3 is a tank apparatus according to example 1 or 2, wherein the authentication circuit comprises a demodulator for demodulating a wanted signal modulated onto the supply voltage.

Example 4 is a tank apparatus according to any of examples 1 to 3, wherein the authentication circuit comprises a modulator for modulating a wanted signal onto the supply voltage.

Example 5 is a tank apparatus according to any of examples 1 to 4, wherein the authentication circuit comprises a wanted-signal terminal for receiving and/or sending a wanted signal.

Example 6 is a tank apparatus according to any of examples 1 to 5, wherein at least one of the supply lines forms a connecting terminal external to the tank apparatus for the purpose of connecting a voltage supply external to the tank apparatus.

Example 7 is a tank apparatus according to any of examples 1 to 6, wherein the two supply lines are connected as a pair to the two supply terminals in an electrically conductive manner.

Example 8 is a tank apparatus according to any of examples 1 to 6, wherein precisely one of the supply lines forms a connecting terminal external to the tank apparatus for the purpose of connecting a voltage supply external to the tank apparatus, wherein precisely one of the supply terminals is a connecting terminal external to the tank apparatus for connecting the voltage supply external to the tank apparatus, and wherein precisely one of the supply lines is connected to precisely one of the supply terminals in an electrically conductive manner.

Example 9 is an electronic inhalation device comprising a tank apparatus according to any of examples 1 to 8.

Example 10 is an electronic inhalation device according to example 9, which additionally comprises a voltage source for providing the voltage supply to the tank apparatus.

Example 11 is an electronic inhalation device according to example 9 or 10, which additionally comprises a processor or a plurality of processors designed to perform an authentication of a tank apparatus attached to the electronic inhalation device.

Example 12 is a method for authenticating a tank apparatus of an electronic inhalation device. The method comprises connecting a tank apparatus of an electronic inhalation device to a base device of the electronic inhalation device such that at least one of two supply lines for applying an electrical supply voltage to an electrical heating apparatus is connected in an electrically conductive manner to at least one of two supply terminals for applying an electrical supply voltage to an authentication circuit designed to authenticate the tank apparatus. The method additionally comprises providing authentication data from the authentication circuit to the base device, and determining, on the basis of the provided authentication data, whether the tank apparatus is authorized to be operated with the base device.

The invention claimed is:

1. A tank apparatus for an electronic inhaler, said tank apparatus comprising:

a receptacle configured to hold a liquid to be vaporized;

two supply lines configured to supply a supply voltage to an electrical heater; and an authentication circuit configured to authenticate the tank apparatus, wherein the authentication circuit comprises:

two supply terminals configured to apply the supply voltage, wherein at least one of the supply lines is connected to at least one of the supply terminals in an electrically conductive manner; and a data signal terminal arranged between the two supply terminals, and configured to receive and/or send a data signal.

2. The tank apparatus as claimed in claim 1, further comprising:

an electrical heater configured to vaporize the liquid held in the receptacle, wherein the two supply lines are connected to the electrical heater in an electrically conductive manner.

3. The tank apparatus as claimed in claim 1, wherein the authentication circuit comprises a demodulator configured to demodulate a data signal modulated onto the supply voltage.

4. The tank apparatus as claimed in claim 1, wherein the authentication circuit comprises a modulator configured to modulate a data signal onto the supply voltage.

5. The tank apparatus as claimed in claim 1, wherein the authentication circuit comprises a data-signal terminal configured to receive and/or send a data signal.

6. The tank apparatus as claimed in claim 1, wherein at least one of the supply lines forms a connecting terminal that is external to the tank apparatus and configured to connect a voltage supply external to the tank apparatus.

7. The tank apparatus as claimed in claim 1, wherein the two supply lines are connected as a pair to the two supply terminals in an electrically conductive manner.

8. The tank apparatus as claimed in claim 1, wherein precisely one of the supply lines forms a connecting terminal that is external to the tank apparatus and is configured to connect a voltage supply external to the tank apparatus, wherein precisely one of the supply terminals is a connecting terminal that is external to the tank apparatus and is configured to connect the voltage supply external to the tank apparatus, and wherein precisely one of the supply lines is connected to precisely one of the supply terminals in an electrically conductive manner.

9. An electronic inhaler comprising a tank apparatus as claimed in claim 1.

10. An electronic inhaler as claimed in claim 9, further comprising:

a voltage source configured to provide the supply voltage to the tank apparatus.

11. An electronic inhaler as claimed in claim 9, further comprising:

one or more processors configured to perform authentication of the tank apparatus attached to the electronic inhaler.

* * * * *